US006560315B1

(12) United States Patent
Price et al.

(10) Patent No.: US 6,560,315 B1
(45) Date of Patent: May 6, 2003

(54) THIN ROTATING PLATE TARGET FOR X-RAY TUBE

(75) Inventors: John Scott Price, Wauwatosa, WI (US); Michael D. Drory, Peterborough, NH (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 10/063,770

(22) Filed: May 10, 2002

(51) Int. Cl.[7] ..... H01J 35/10
(52) U.S. Cl. ..... 378/144; 378/125
(58) Field of Search ..... 378/144, 143, 378/125; 313/60, 55

(56) References Cited

U.S. PATENT DOCUMENTS 4,119,261 A 10/1978 Devine, Jr. ..... 228/113
4,129,241 A 12/1978 Devine, Jr. ..... 228/113
4,250,425 A 2/1981 Gabbay et al. ..... 378/125
5,875,228 A 2/1999 Truszkowska ..... 378/144
5,907,592 A * 5/1999 Levinson ..... 378/4
5,943,389 A 8/1999 Lee ..... 378/144
6,430,264 B1 * 8/2002 Lee ..... 378/144

* cited by examiner

*Primary Examiner*—Robert H. Kim
*Assistant Examiner*—Irakli Kiknadze
(74) *Attorney, Agent, or Firm*—Cantor Colburn LLP

(57) ABSTRACT

A method and apparatus for a rotatable anode of an x-ray tube. The anode having an axis of rotation and includes a solid thin plate target having a substantially planar base surface extending from the axis of rotation to a periphery outlining the base surface, wherein the plate target includes target material for generating x-rays selected from a group of high-Z materials. The plate target has a thickness of about 1 mm or less. The method includes fabricating the thin plate target using silicon wafer processing technology using suitable materials for such technology in forming the plate target selected from the group of high-Z materials.

32 Claims, 3 Drawing Sheets

THIN ROTATING PLATE TARGET FOR X-RAY TUBE

BACKGROUND OF INVENTION

The x-ray tube has become essential in medical diagnostic imaging, medical therapy, and various medical testing and material analysis industries. Typical x-ray tubes are built with a rotating anode structure that is rotated by an induction motor comprising a cylindrical rotor built into a cantilevered axle that supports the disc shaped anode target, and an iron stator structure with copper windings that surrounds the elongated neck of the x-ray tube that contains the rotor. The rotor of the rotating anode assembly being driven by the stator which surrounds the rotor of the anode assembly is at anodic potential while the stator is referenced electrically to ground. The x-ray tube cathode provides a focused electron beam which is accelerated across the anode-to-cathode vacuum gap and produces x-rays upon impact with the anode target. The target typically comprises a disk made of a refractory metal such as tungsten, molybdenum or alloys thereof and the x-rays are generated by making the electron beam collide with this target, while the target is being rotated at high speed. High speed rotating anodes can reach 9,000 to 11,000 RPM.

Only a small surface area of the target is bombarded with electrons. This small surface area is referred to as the focal spot, and forms a source of x-rays. Thermal management is critical in a successful target anode, since over 99 percent of the energy delivered to the target anode is dissipated as heat, while significantly less than 1 percent of the delivered energy is converted to x-rays. Given the relatively large amounts of energy which are typically conducted into the target anode, it is understandable that the target anode must be able to efficiently dissipate heat. The high levels of instantaneous power delivered to the target, combined with the small size of the focal spot, has led designers of x-ray tubes to cause the target anode to rotate, thereby distributing the thermal flux throughout a larger region of the target anode. There are various techniques for distributing thermal flux, for example, faster rotation speeds or greater target anode diameters, that allow for decreasing the thermal energy at any given location along the focal track.

However, there is a practical limitation regarding a maximum speed at which the target anode can be rotated, and in the size of practical target anode diameters. The materials of the target anode will eventually shatter at certain speeds and larger diameters.

Operating conditions for x-ray tubes have changed considerably in the last two decades. U.S. Pat. No. 4,119,261, issued Oct. 10, 1978, and U.S. Pat. No. 4,129,241, issued Dec. 12, 1978, were both devoted to joining rotating anodes made from molybdenum and molybdenum-tungsten alloys to stems made from columbium and its alloys. Continuing increases in applied energy during tube operation have led to a change in target composition to titanium zirconium molybdenum (TZM) TZM is a trademark of Metalwork Plansee or other molybdenum alloys, to increased target diameter and weight, as well as to the use of graphite as a heat sink in the back of the target. Future computerized tomography (CT) scanners will be capable of decreasing scan time from a one second rotation to a 0.5 second rotation or lower. However, such a decrease in scan time will quite possibly require a modification of the current CT anode design. The current CT anode design comprises two disks, one of a high heat storage material such as graphite, and the second of a molybdenum alloy such as TZM. These two concentric disks are bonded together by means of a brazing process.

A thin layer of refractory metal such as tungsten or tungsten alloy is deposited to form a focal track. Such a composite substrate structure may weigh in excess of 4 kg.

With faster scanner rotation rates, heavy targets will increase not only mechanical stress on the bearing materials but also a focal spot sag motion causing image artifacts.

Furthermore, there is a demonstrated need for multi-energy or multiple target material sources of x-radiation. In mammography, for example, the image contrast is enhanced by using Mo and Rh target tracks with two separate electron beam sources. However, using two tracks with two electron beam sources increases mechanical complexity of high voltage, high power x-ray tubes due to the size of the resulting target and the consequent design choices that must be made: the size and mass of the rotor, stator, and certain features of the vacuum enclosure which act as the support frame. In addition, there are certain limitations to this design, for example, only two materials may be employed and two electron beam sources may be required, as in mammography. The large mass anode assembly makes changing target materials unfeasible or inconsistent with present design goals.

Accordingly, it would be desirable over the state of the art to provide a target anode structure and material which is capable of high speeds of rotation, and which is less sensitive to thermal stresses. It would also be desirable to provide a new method of creating a layer of x-ray emissive material on a target anode substrate which would not be subject to delamination. It would be desirable then to replace the present CT target design with a lightweight design comparable in thermal performance, particularly suited for use in x-ray rotating anode assemblies.

SUMMARY OF INVENTION

The above discussed and other drawbacks and deficiencies are overcome or alleviated by a rotatable anode for x-ray tube comprising: a solid thin plate target selected from a group of high-Z materials selectively deposited onto a substrate material including silicon, silicon carbide, aluminum nitride, gallium arsinide, glass or other commercially available thin disk substrate material. The substrate material includes single crystal, polycrystalline and amorphous forms. The plate target includes a substantially planar base surface extending from the axis of rotation to a periphery outlining the base surface, wherein the plate target includes target material for generating x-rays. The plate target has a thickness of about 1 mm or less.

In an alternative embodiment, a method for manufacturing a rotatable anode for an x-ray tube is disclosed. The method comprising: fabricating a thin plate target with silicon wafer processing technology using suitable materials for such technology in forming the plate target selected from a group of high-Z materials. The plate target includes an axis of rotation and a thickness of about 1 mm or less.

The above discussed and other features and advantages of the present invention will be appreciated and understood by those skilled in the art from the following detailed description and drawings.

BRIEF DESCRIPTION OF DRAWINGS

Referring to the exemplary drawings wherein like elements are numbered alike in the several Figures.

DETAILED DESCRIPTION

Figure 1:
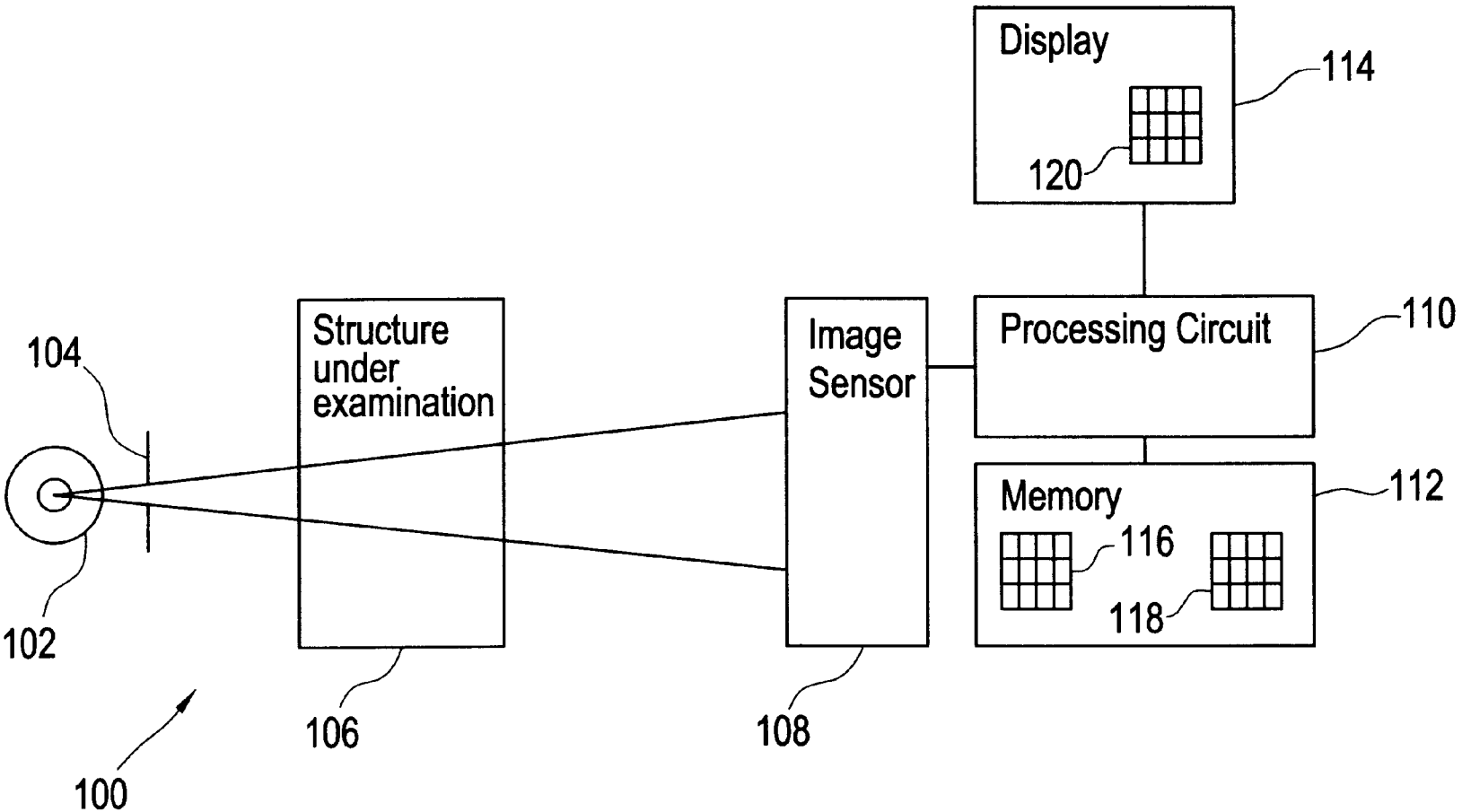
FIG. 1 illustrates a high level diagram of an x-ray imaging system.

Turning now to FIG. 1, that figure illustrates an x-ray imaging system 100. The imaging system 100 includes an x-ray source 102 and a collimator 104, which subject structure under examination 106 to x-ray photons. As examples, the x-ray source 102 may be an x-ray tube, and the structure under examination 106 may be a human patient, test phantom or other inanimate object under test.

The x-ray imaging system 100 also includes an image sensor 108 coupled to a processing circuit 110. The processing circuit 110 (e.g., a microcontroller, microprocessor, custom ASIC, or the like) couples to a memory 112 and a display 114.

The memory 112 (e.g., including one or more of a hard disk, floppy disk, CDROM, EPROM, and the like) stores a high energy level image 116 (e.g., an image read out from the image sensor 108 after 110–140 kvp 5 mAs exposure) and a low energy level image 118 (e.g., an image read out after 70 kVp 25 mAs exposure). The memory 112 also stores instructions for execution by the processing circuit 110, to cancel certain types of structure in the images 116–118 (e.g., bone or tissue structure). A structure cancelled image 120 is thereby produced for display.

Figure 2:
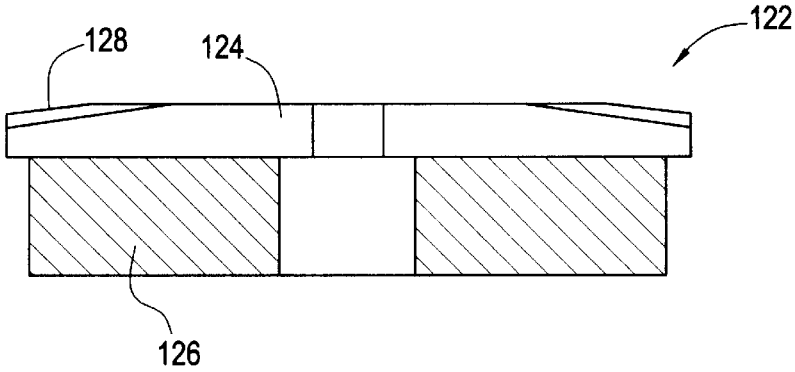
FIG. 2 PRIOR ART
FIG. 2 is a profile cross sectional view of a state of the art target anode which includes a substrate, where the substrate is typically composed of a carbon material (e.g. graphite)

Referring now to FIG. 2, a typical prior art CT anode target 122 suitable for use in x-ray tube 102 is illustrated. The current CT anode 122 design comprises two disks 124 and 126. One disk 126 is of a high head storage material such as graphite, and the second disk 124 is of a molybdenum alloy such as titanium zirconium molybdenum (TZM) TZM is a trademark of Metalwork Plansee. These two concentric disks are bonded together by means of a brazing process. A thin layer of refractory metal such as tungsten or tungsten alloy is deposited to form a focal track 127. Such a composite substrate structure may weigh in excess of 4 kg. With faster scanner rotation rates, heavy targets will increase not only mechanical stress on the bearing materials but also a focal spot sag motion causing image artifacts.

The present disclosure proposes tailored silicon wafer processing material structures to replace the graphite material in existing CT scanner systems. The present disclosure proposes the use of existing silicon wafer processes and technologies, well known in the art, applied to a rotable target, to achieve thin lightweight anode structures.

Figure 3:
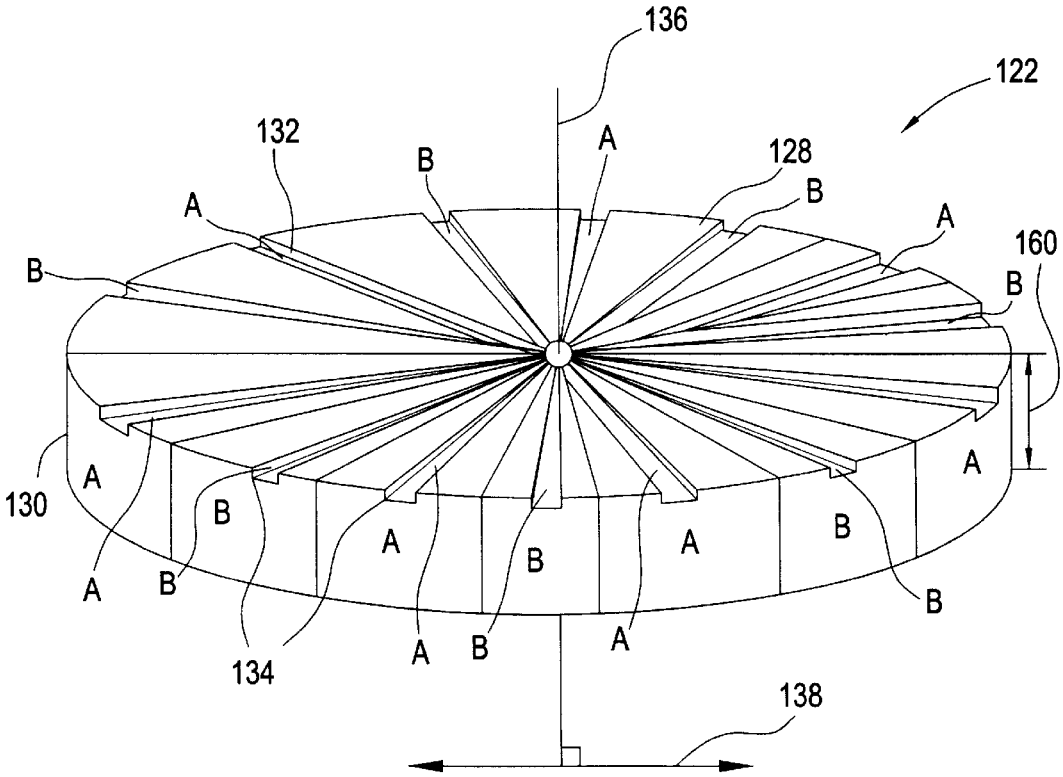
FIG. 3 is a perspective view of an exemplary embodiment of a target anode having two different target materials interleaved therein in an ABABAB pattern.

FIG. 3 illustrates an exemplary embodiment of a thin plate target anode 122 in a perspective view. The target anode 122 is comprised of a substrate 130. An x-ray emissive target material 128 is deposited on a substantially planar base surface 132 of substrate 130. Base surface 132 is preferably configured with micro-channels 134 to provide cooling when plate target 122 rotates. Cooling micro-channels 134 are capable of handling about 10 to about 100 kW and can be machined into substrate structures by etching or photoresist, for example, a silicon substrate 130 that acts as the target material support. This cooling technique makes it possible to dissipate large thermal fluxes away from target anode 122. The x-ray emissive target material 128 in this type of target anode is deposited using a technique such as chemical vapor deposition (CVD) or physical vapor deposition (PVD); both are well known techniques in silicon wafer processing. Two different x-ray emissive materials, A and B, are preferably deposited in an alternating manner with respect to each other forming alternating materials in one focal track. In this manner, when anode 122 rotates about an axis of rotation 136, an electron beam (not shown) focused on base surface 132 will strike either emissive material A or B providing differing spectral content of x-ray generation from a respective focal track. In alternative embodiments, emissive material A and B may be disposed concentrically with respect to each other and more than one electron beam may be used, where each beam is focused to strike one of the two emissive materials A or B. Preferably, however, one electron beam is used and target anode 122 is translatable in a direction 138 perpendicular to axis 136 for focusing a beam on a number of different focal tracks concentrically disposed on base surface 132 as anode 122 translates in direction 138. In addition, when emissive material A and B is interleaved as illustrated in FIG. 3 and rotatable target anode 122 is translatable in direction 138, a focused electron beam can be directed on substantially all of the target material 128 disposed on base surface 132. It will be appreciated that more than two emissive materials may be used as the target material 128 as well. Likewise, it will also be recognized that substrate 130 and emissive target material 128 may be one and the same providing a unitary substrate thin plate target anode 122 made from a high-Z material. Substrate 130 may be composed of one of the following, including combinations of at least one of the following materials: silicon, silicon carbide, aluminum nitride, carbon, and Gas.

Figure 4:
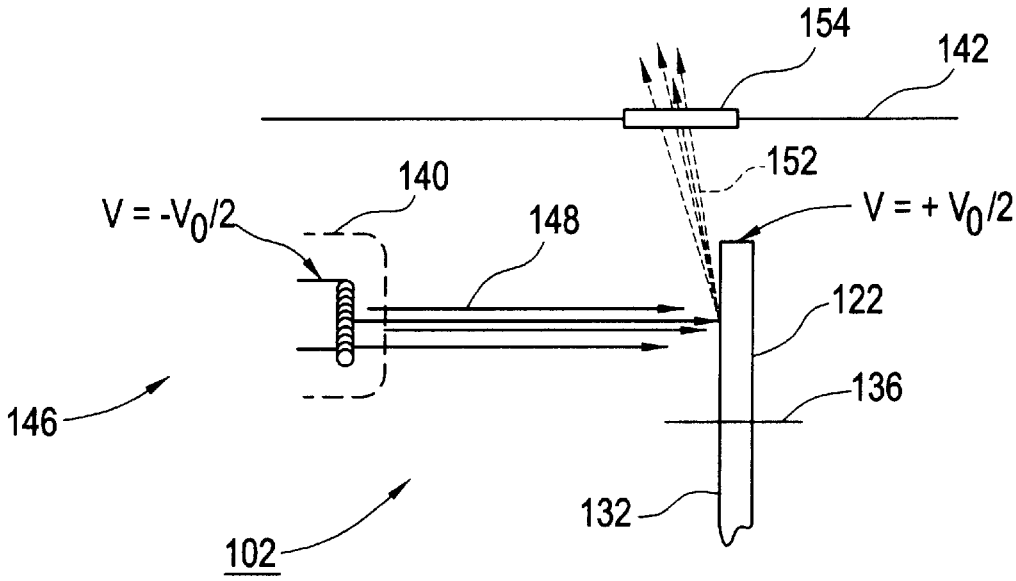
FIG. 4 is a schematic view of an x-ray tube illustrating a partial view of the target anode of FIG. 3.

Referring now to FIG. 4, the plate target 122, with multiple materials A and B deposited on the surface 132 shown in FIG. 3, is illustrated in cooperation with a generic arrangement of a cathode 140, and a surrounding frame surface 142 of an x-ray tube insert 146 as the x-ray source 102. Cathode 140 generates an electron beam 148 that is incident upon the base surface 132 of thin rotating plate target 122. As shown in FIG. 3, the target has two focal tracks (i.e., A and B) that are separated on the target surface 132 in radius from the center of rotation 136. In a preferred embodiment, the different target materials A and B are interleaved, A, B, A, B as shown in FIG. 3. In this embodiment, the electron beam 148 is gated by means of gridding or pulsing the high voltage, as is the case in present x-ray tube designs, to match the arrival of the track portions that are exposed to the focal spot of the electron beam 148. This arrangement of the two materials A and B allows for the advance of the target rotation axis to permit the use of the entire thin target disk by a means for translation of the disk 122 in a direction substantially perpendicular to the axis of rotation 136.

FIG. 4 illustrates back-scattering x-ray generation, e.g. electrons are incident upon the target material (i.e., A and B) and the x-rays 152 escape from the material's top layer base surface 132 to exit the insert 146 by means of a beryllium window 154 disposed in frame 142. The thin rotating target 122 can be used for generating x-radiation in transmission mode as well. Instead of massive layers of target material 128, it is also possible to deposit thin layers of high-Z material. The incident electrons impinge upon the material 128, generate the x-rays 152 by bremsstrahlung process, and the x-rays 152 emerge from the back side of the thin layer of material 128. It will be appreciated that there is an associated filtration due to the thickness of the substrate 130, density, atomic number and energy. For example, thin layers of target material 128 can be directly deposited onto a substrate 130 like silicon. Silicon has a Z=14 and as such submits the x-rays 152 to much less filtration than typically tolerated total filtration for an x-ray insert, of the order of 0.15 mm of Cu (for CT tubes). It will be recognized that silicon is commonly used as a semiconductor substrate material. As such, well-known techniques of etching, photoresist, and architecture of microscopic structures are easily employed to the deposition of any desired configuration of target zones.

More than two materials can be deposited for a wider choice of procedures and protocols and energy-dependent digital image subtraction methods, such as used currently in angiography. Many different materials can be deposited onto the surface or into wells or depressions designed for the materials and the particular deposition techniques, preferably including but not limited to, W, Mo, Rh, U, Pb. In other exemplar embodiments the list of other suitable materials include metals such as, Ta, Hf, Pt, Au, Ti, Zr, Nb, Ag, V, Co, Cu, in descending order of Z, atomic number. In other target technology applications, high performance ceramics are optionally used. Whether one, two or more materials are used in the target, the electron beam voltage and current can be varied to produce the optimal contrast-to-dose and spectral content depending upon the desired image, modality, physiology and associated pathology In an exemplary embodiment referring again to FIG. 3, the target anode is composed of 1 mm thick 160 silicon having a diameter of about 300 mm for mechanical stability necessary to survive fabrication, loading and mechanical stresses associated with acceleration/deceleration and thermal loads. Current automated semiconductor fabrication techniques can be applied to mass-produce such targets. The mass of such an exemplary silicon target 122 is about 0.14 kg, which is approximately 40 times less than currently known high-power CT x-ray tube targets. The light weight of the target disks 122 permit using high speed spindle technology routinely used in rotating mechanisms for semiconductor manufacturing. These spindle mechanisms involve conventional (hybrid) bearing technology through a ferrofluidic feedthrough, or (in vacuum) bearings with low-vapor pressure vacuum grease. The light weight of the targets also permits throw-away or single-procedure or protocol use for a target. For example, carousels loaded with several targets can optionally be used in an x-ray tube insert 146. Alternatively, a load-lock arrangement can be used to shuttle targets into and out of the x-ray tube.

Figure 5:
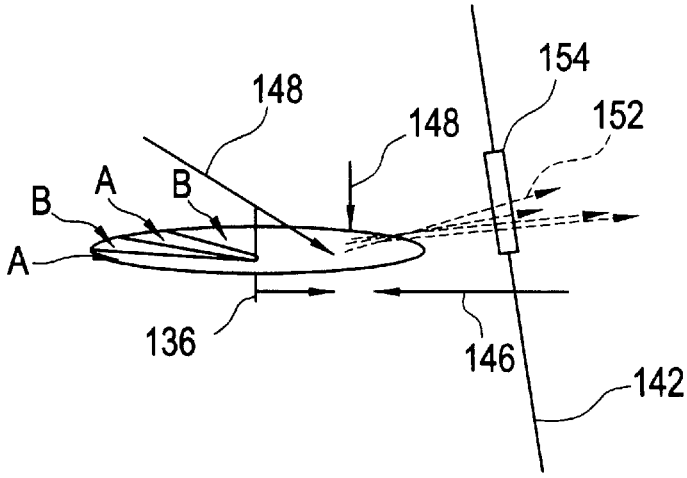
FIG. 5 is schematic view of the target anode of FIG. 3 illustrating two electromagnetic beam incident angles and an axis relative to rotation and translation of the target anode.

Referring to FIG. 5, electron beam 148 is incident upon the target material 128 at an angle relative to base surface 132 ranging from about 20 degrees to about 90 degrees (i.e., normal incidence). It has been found through experimentation that optimization of the x-ray output per unit heat deposited in the target occurs at about 20 degrees.

In an alternate embodiment, laser ablation plasma x-ray generation is optionally used with the thin rotating target 122. This use of the thin rotating disk target 122 with a mechanical axis advance mechanism as a means for translation of anode 122 in a direction depicted with arrows 166 is particularly well suited for the ablation techniques of x-ray production. The ablation method is destructive and management of pressure excursions and target ejecta is a concern. Sufficient pumping (whether by active means or by means of bulk or surface getter technology) will alleviate the problems with pressure. Baffles are typically employed to limit the straight-line paths that target molecules follow which can result in fouling of x-ray transparent windows 154. Once the target has been used, it can be swapped out either by the load-lock method or by the carousel advance method discussed above.

While it is understood that there is a certain amount of mechanical rigidity demanded by the aiming system for the electron beam or laser beam, the light weight anode and target presents a number of significant advantages. Lower mass targets imply lower mass motor elements to drive target rotation. Thus, the rotor and stator need not be as large as in traditional 4 to 6 kg target assemblies. This lowers total material costs as well as costs related to manufacture and processing. Semiconductor manufacturing technology can be leveraged to accomplish this particular technical task. The power supply that is required in order to rotate the target is smaller and less power is required at the x-ray tube insert 146. Smaller power supplies cost less to begin with and occupy less space in high voltage generators. Furthermore, the wires, connectors, and associated hardware costs are lower. The bearing will be lighter in weight, have reduced wear, and be much quieter. Smaller bearings cost less to produce in terms of materials, and cost less to process. High-speed rotation is implied by the target weight reduction. This means lower peak focal spot temperatures as analyzed by traditional track temperature calculation algorithms. While the distribution of track/target material is different compared to a traditional thick target, any significant reduction in temperature while maintaining x-radiation output is an important gain. The bearing can be of the sealed bearing type. Since the bearing itself is not exposed to the chamber where relatively low pressure is necessary, a variety of lubricants and noise-abatement strategies can be adopted for optimized bearing performance.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A rotatable anode for x-ray tube having an axis of rotation comprising:

a solid thin plate target including a substantially planar base surface, said base surface extending from the axis of rotation to a periphery outlining said base surface, wherein said plate target includes a target material for generating x-rays selected from a group of high-Z materials, said plate target having a thickness of about 1 mm or less.

2. The rotatable anode for x-ray tube of claim 1, wherein said base surface of said plate target includes said target material covering at least a portion of said base surface, said target material is deposited on said base surface.

3. The rotatable anode for x-ray tube of claim 1, wherein said target material includes two different target materials interleaved relative to each other on said base surface so as at least one of the two different target materials is exposed to a focal spot of an electron beam directed thereon as said plate target rotates about the axis of rotation.

4. The rotatable anode for x-ray tube of claim 1, wherein said target material includes at least two different target materials relative to each other on said base surface at different radii being concentric so as at least one of the two different target materials is exposed to a focal spot of an electron beam directed thereon as said plate target rotates about the axis of rotation and translates in a direction perpendicular to the axis of rotation.

5. The rotatable anode for x-ray tube of claim 1, wherein said target material includes a plurality of different target materials relative to each other on said base surface to provide altering spectral content when an electron beam is incident upon said target material.

6. The rotatable anode for x-ray tube of claim 1, wherein said base surface is shaped as a substantially concentric circle centered about said axis of rotation and extending from a proximal radius relative to said axis of rotation to a distal radius relative to said axis of rotation.

7. The rotatable anode for x-ray tube of claim 1, wherein said base surface includes micro-channels configured therein to provide cooling for the rotable anode.

8. The rotatable anode for x-ray tube of claim 1, wherein said target material is selected from a group of high Z materials.

9. The rotatable anode for x-ray tube of claim 8, wherein the group of high Z materials includes at least one of, including combinations of at least one of: W, Mo, Rh, U, Pb, Ta, Hf, Pt, Au, Ti, Zr, Nb, Ag, V, Co, Cu, and high performance ceramics.

10. The rotatable anode for x-ray tube of claim 1, wherein said plate target forming material is selected from the group of silicon, silicon carbide, aluminum nitride, carbon, and Gas.

11. The rotatable anode for x-ray tube of claim 1, wherein the mass of the rotable anode is about 2 kg or less.

12. A rotatable anode for an anode assembly comprising:

a solid thin plate target having a substantially planar base surface, said base surface extending from the axis of rotation to a periphery outlining said base surface, wherein said plate target includes at least one target material for generating x-rays selected from a group of high Z materials, said plate target having a thickness of about 1 mm or less, said plate target is suitable for use in back-scattering mode and transmission mode generation of x-rays.

13. The rotatable anode for an anode assembly of claim 12, wherein said plate target is adapted for replacement after limited use.

14. An x-ray tube comprising:

a cathode configured to generate an electron beam from a high voltage source;

a rotatable anode having a target aligned to receive said beam;

a frame enclosing said cathode and said anode, said frame having a window configured to allow emission of x-rays emitted from said target upon incidence of said beam, wherein said target of the rotatable anode for x-ray tube having an axis of rotation further comprising:

a solid thin plate target having a substantially planar base surface, said base surface extending from the axis of rotation to a periphery outlining said base surface, said plate target includes at least one target material for generating x-rays selected from a group of high Z materials, said plate target having a thickness of about 1 mm or less.

15. The x-ray tube of claim 14, wherein said base surface of said plate target includes said target material covering at least a portion of said base surface, said target material is deposited on said base surface.

16. The x-ray tube of claim 14, wherein said target material includes two different target materials interleaved relative to each other on said base surface so as at least one of the two different target materials is exposed to a focal spot formed by an electron beam directed thereon as said base surface rotates about the axis of rotation.

17. The x-ray tube of claim 14, wherein said target material includes at least two different target materials relative to each other on said base surface at different radii being concentric so as at least one of the two different target materials is exposed to a focal spot formed by an electron beam directed thereon as said plate target rotates about the axis of rotation and translates in a direction perpendicular to the axis of rotation.

18. The x-ray tube of claim 14, wherein said target material includes a plurality of different target materials relative to each other on said base surface to provide altering spectral content when an electron beam is incident upon said target material.

19. The x-ray tube of claim 14, wherein said base surface is shaped as a substantially concentric circle centered about said axis of rotation and extending from a proximal radius relative to said axis of rotation to a distal radius relative to said axis of rotation.

20. The x-ray tube of claim 14, wherein said base surface includes micro-channels configured therein to provide cooling for the rotable anode.

21. The x-ray tube of claim 14, wherein said plate target forming material is selected from the group of silicon, silicon carbide, aluminum nitride, carbon, and Gas.

22. An x-ray tube suitable for use in back-scattering mode and transmission mode generation of x-rays comprising:

a cathode configured to generate an electron beam from a high voltage source;

a rotatable anode having a target aligned to receive said beam; and a frame enclosing said cathode and said anode, said frame having a window configured to allow emission of x-rays emitted from said target upon incidence of said beam, said frame having a means for access therein to replace said anode, wherein said target of the rotatable anode for x-ray tube having an axis of rotation, said target further includes, a solid thin plate target having a substantially planar base surface, said base surface extending from the axis of rotation to a periphery outlining said base surface, said plate target includes at least one target material for generating x-rays selected from a group of high-Z materials, said plate target having a thickness of about 1 mm or less.

23. The x-ray tube of claim 22, further including a means for translating said rotable anode in a direction substantially perpendicular to said axis of rotation.

24. The x-ray tube of claim 22, wherein said electron beam is one of an electron beam and a laser beam.

25. The x-ray tube of claim 24, wherein said electron beam is focused on said target at an incidence angle of between about 90 degrees to about 20 degrees relative to said base surface.

26. The x-ray tube of claim 22, wherein said window in said frame of the x-ray tube is composed of beryllium.

27. The x-ray tube of claim 22, wherein said means for access includes one of a load lock mechanism and a carousel advance mechanism adapted to replace a target in said x-ray tube.

28. The x-ray tube of claim 22, wherein said anode is rotatable in said x-ray tube via a bearing exteriorly disposed thereof.

29. A method for manufacturing a rotable anode for an x-ray tube, the method comprising:

fabricating a thin plate target with silicon wafer processing technology using suitable materials for such technology in forming said plate target selected from a group of high-Z materials, said plate target having an axis of rotation including a thickness of about 1 mm or less.

30. The method of claim 29 further comprising:

forming micro-channels in a base surface of said plate target, said micro-channels configured to provide cooling of the rotable anode.

31. The method of claim 30 further comprising:

depositing a target material on said base surface covering at least a portion of said base surface, said target material comprising a high-Z target material.

32. The method of claim 31, wherein said depositing a target material includes two different target materials interleaved relative to each other on said base surface so as at least one of the two different target materials is exposed to a focal spot of a stationary electron beam directed thereon as said anode rotates about the axis of rotation.

* * * * *

UNITED STATES PATENT AND TRADEMARK OFFICE

CERTIFICATE OF CORRECTION

PATENT NO. : 6,560,315 B1
DATED : May 6, 2003
INVENTOR(S) : Price et al.

It is certified that error appears in the above-identified patent and that said Letters Patent is hereby corrected as shown below:

Column 3,
Line 30, delete “kvp” and insert -- kVp --.

Column 4,
Line 36, delete “Gas” and insert -- GaAs --.

Column 5,
Line 30, after “pathology” insert -- . --.

Column 7,
Line 37, delete “Gas” and insert -- GaAs --.

Column 8,
Line 38, delete “Gas” and insert -- GaAs --.

Signed and Sealed this

Eleventh Day of April, 2006

JON W. DUDAS
*Director of the United States Patent and Trademark Office*